US005564131A

United States Patent [19]

Anscher

[11] Patent Number: 5,564,131

[45] Date of Patent: Oct. 15, 1996

[54] BREAKAWAY BUCKLE FOR USE IN COUPLING SUSPENDERS AND THE LIKE TO A BACK SUPPORTING BELT AND THE LIKE

[75] Inventor: Joseph Anscher, Muttontown, N.Y.

[73] Assignee: National Molding Corp., Farmingdale, N.Y.

[21] Appl. No.: 388,002

[22] Filed: Feb. 13, 1995

[51] Int. Cl.[6] ..... A41F 1/00; A41F 15/00

[52] U.S. Cl. ..... 2/340; 2/45; 2/336; 24/602; 24/669; 24/702

[58] Field of Search ..... 2/44, 45, 92, 310, 2/311, 312, 338, 323, 336, 340, 334; 450/156, 88; 24/669 R, 662, 694, 695, 702 R, 602; 602/19

[56] References Cited

U.S. PATENT DOCUMENTS

| | | | |
|---|---|---|---|
| 456,636 | 7/1891 | Perry | 24/669 |
| 766,500 | 8/1904 | Hatfield | 24/669 |
| 1,203,771 | 11/1916 | Nichols | 24/702 X |
| 1,519,380 | 12/1924 | Kochanski | 24/669 |
| 3,872,513 | 3/1975 | Beaudin, Jr. et al. | 2/155 OR |
| 4,161,806 | 7/1979 | Hennisse et al. | 24/695 X |
| 5,349,706 | 9/1994 | Keer | 2/44 X |

*Primary Examiner*—Jeanette E. Chapman
*Attorney, Agent, or Firm*—Kenyon & Kenyon

[57] ABSTRACT

A buckle which includes a first member having a nipple around which a second member can rotate in the plane of the buckle. The buckle can advantageously be used to couple a back supporting belt to a shoulder strap of a pair of suspenders or the like. The rotational movement of one buckle member with respect to the other buckle member in the plane of the buckle facilitates adjustment of the shoulder straps to accommodate the various shoulder widths of different wearers. The first and second buckle members are adapted to breakaway or decouple when the buckle is subjected to a load or force greater than a predetermined level.

8 Claims, 3 Drawing Sheets

FIG. 1
(PRIOR ART)
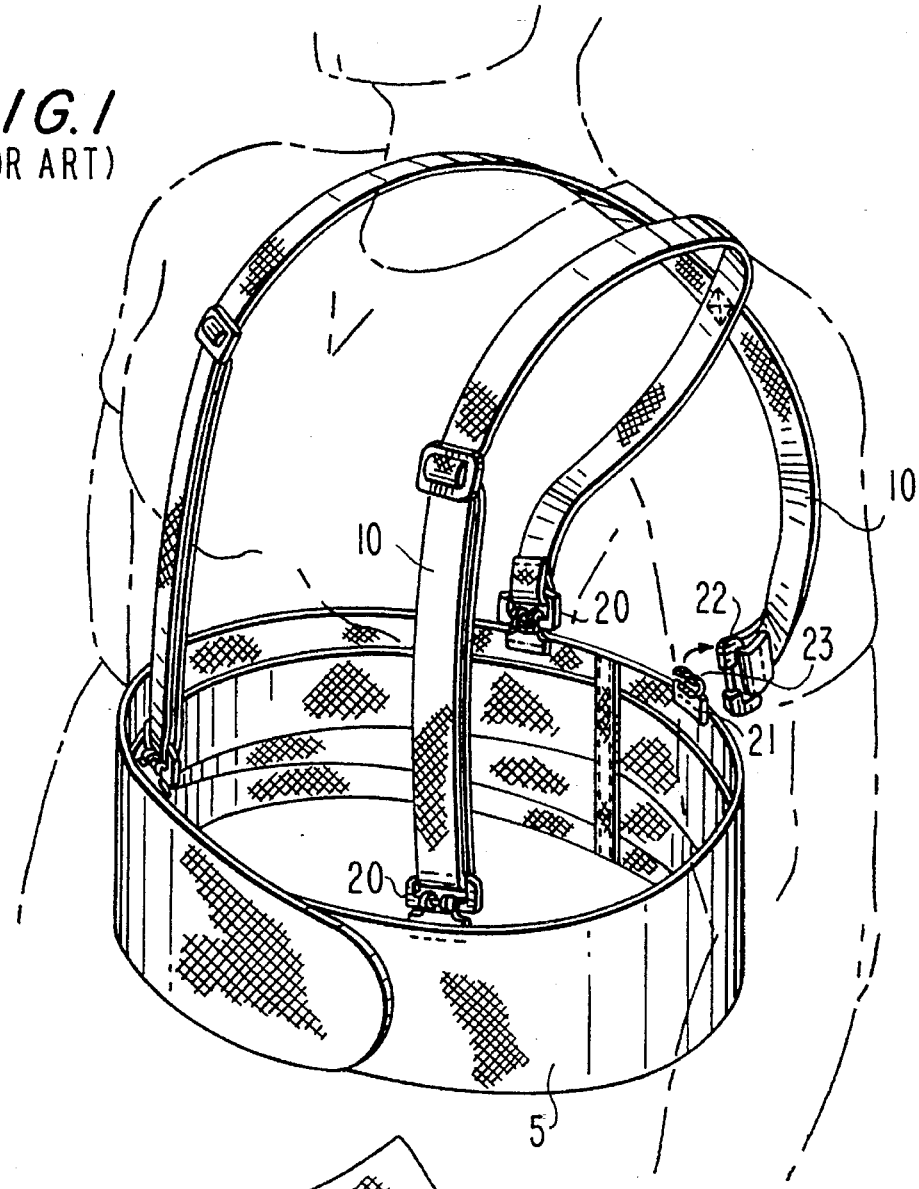
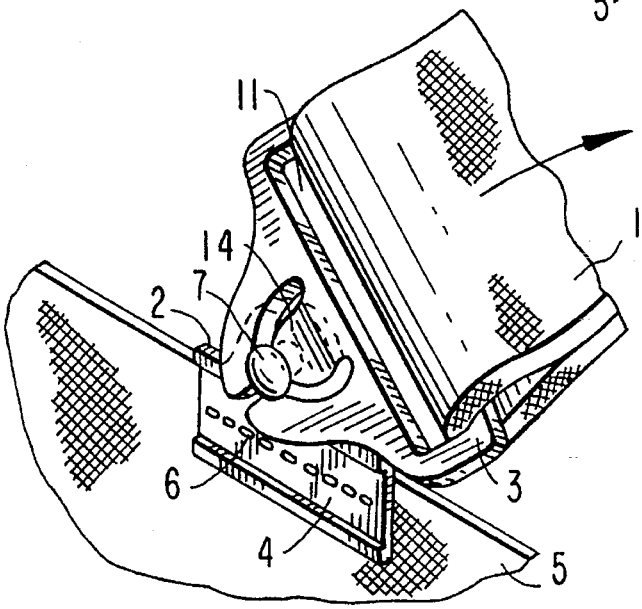
FIG. 2

BREAKAWAY BUCKLE FOR USE IN COUPLING SUSPENDERS AND THE LIKE TO A BACK SUPPORTING BELT AND THE LIKE

BACKGROUND OF THE INVENTION

1. Field of the Invention

The invention relates generally to a two-piece buckle which is useful for coupling a back supporting belt to suspenders and the like which will breakaway or decouple when placed under a heavy load. More particularly, the invention relates to such a buckle whose individual buckle pieces can swivel in the plane of the buckle to facilitate adjustment and proper orientation of the shoulder straps of the suspenders for ease of use.

2. Description of Related Art

Two-piece breakaway type buckles for coupling lower back supporting belts, such as heavy lifting belts, to the shoulder straps of suspenders are known in the art. A conventional back supporting belt-suspenders combination known in the art is illustrated in FIG. 1. The belt 5 is coupled to the suspenders by a multiplicity of breakaway buckles 20. Each buckle includes a first member 21 which is sewn to the back support belt and a second member 22 containing a cross bar for securing a strap 10 of the suspenders. As can be seen from FIG. 1, the first and second members are coupled at a hinge 23 which permits the second member to pivot with respect to the first member. Specifically, the second member can pivot about the hinge in directions transverse to the plane of the buckle (i.e., the second member can pivot around the hinge in and out of the plane of the buckle). The purpose of allowing for this pivoting movement is to facilitate storage and use of the belt-suspenders combination.

The hinge connecting the first and second members of the breakaway buckle of the prior art is not permanent. Rather, the second member may be decoupled from the first member to permit a person to use the back supporting belt without the suspenders. The ability to decouple the first and second members at the hinge is also a safety feature. Such back supporting belt-suspenders combinations are often worn by persons engaged in heavy lifting near machinery and the like. In the event that the suspenders become caught in machinery, the breakaway buckle will decouple when subjected to a predetermined load.

One drawback to the hinge-type breakaway buckle known in the art is that the first and second members cannot swivel with respect to each other in the plane of the buckle. Rather, they can only pivot transverse to the plane of the buckle. This limitation can make it difficult for the wearer of the back supporting belt-suspenders combination to properly adjust the shoulder straps of the suspenders to the wearer's shoulder width when placing the garment on. In addition, the belt-suspenders combination which includes the breakaway buckle of the prior art can restrict a full range of movement due to the inability of the breakaway buckles to swivel in their own plane.

SUMMARY OF THE INVENTION

Accordingly, it is an object of the invention to provide a breakaway type buckle for coupling a strap (e.g., as part of suspenders) to a back supporting type belt (e.g., for heavy lifting), wherein the members comprising the buckle can swivel (i.e., rotate) with respect to each other in the plane of the buckle. It is a further object of the invention to provide such a buckle wherein the buckle members decouple (i.e., breakaway) under a predetermined load for safety reasons.

These and other objects of the invention are achieved by a two-piece buckle comprising a first member and a second member which can swivel with respect to one another in the plane of the buckle. The first member has a substantially planar tab section which can be permanently attached to the back supporting belt. The first member includes a mushroom-shaped nipple which is adapted to couple the second member to the first member.

The second member is coupled to the first member by a pair of arms which, together with a hemispherical tongue, define an aperture which is adapted to receive the nipple of the first member. In this way, the second member is free to rotate around the nipple, thereby permitting swivelling of the two members in the plane of the buckle. The second member includes a cross bar for securing a strap, e.g. of suspenders.

The arms belonging to the second member are resiliently flexible so that they may be snapped over the nipple to couple the two buckle members together. This resilient flexibility also imparts a breakaway feature to the buckle in that the arms will spread apart under sufficient load and permit the nipple to be released from the aperture.

BRIEF DESCRIPTION OF THE DRAWINGS

FIG. 1 is a perspective view of a back supporting belt coupled to a pair of suspenders by hinge-type breakaway buckles of the prior art.

FIG. 2 is a perspective view of the breakaway buckle of the invention as coupled to a back supporting belt and a strap of a pair of suspenders.

DETAILED DESCRIPTION OF THE INVENTION

Figure 3:
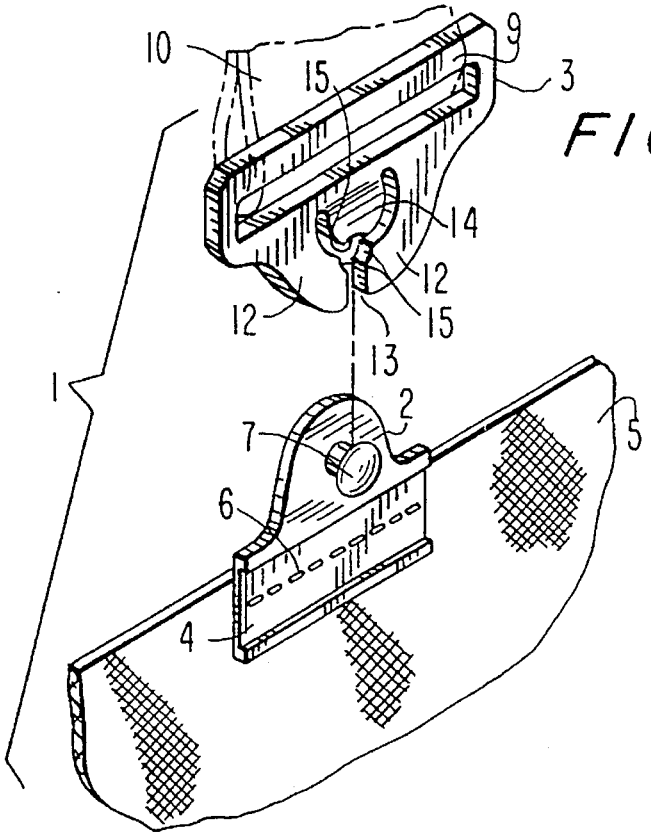
FIG. 3 is a perspective view of the breakaway buckle of the invention wherein the first and second members are decoupled.

Referring to FIG. 3, the buckle of the invention is illustrated in its uncoupled state generally at 1. The buckle includes a first member 2 which is adapted to be coupled to a second member 3. The first member 2 includes a planar tab section 4 which can be attached to a garment, such as a back supporting belt 5. The planar section may be attached to the garment by sewing with a strong nylon thread 6.

Figure 5:
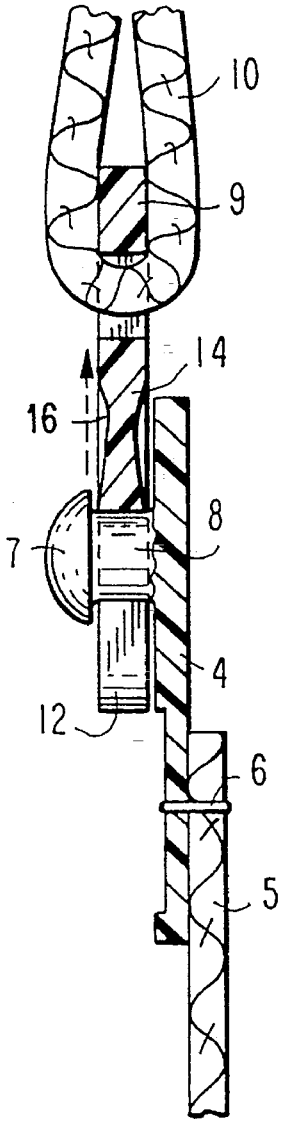
FIG. 5 is a cross-sectional view of the buckle illustrated in FIG. 4 taken along the line 5—5.
Figure 6:
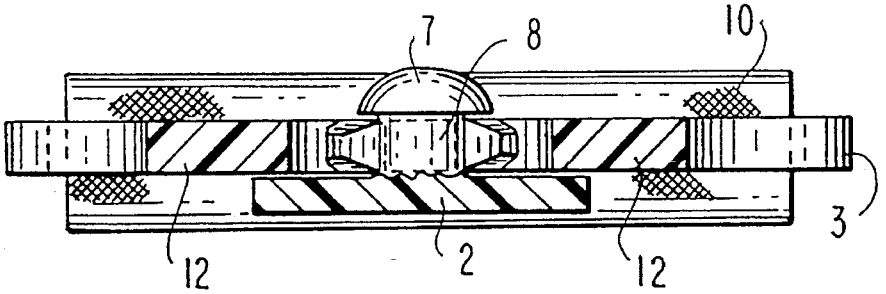
FIG. 6 is a cross-sectional view of the buckle illustrated in FIG. 4 taken along the line 6—6.

The first member includes a generally mushroom-shaped nipple 7. The nipple 7 includes a slender stem portion 8 (see FIGS. 5 and 6) which projects upward from the planar section 4. The top of the mushroom-shaped nipple 7 is generally curved and smooth as illustrated in FIG. 5.

Figure 4:
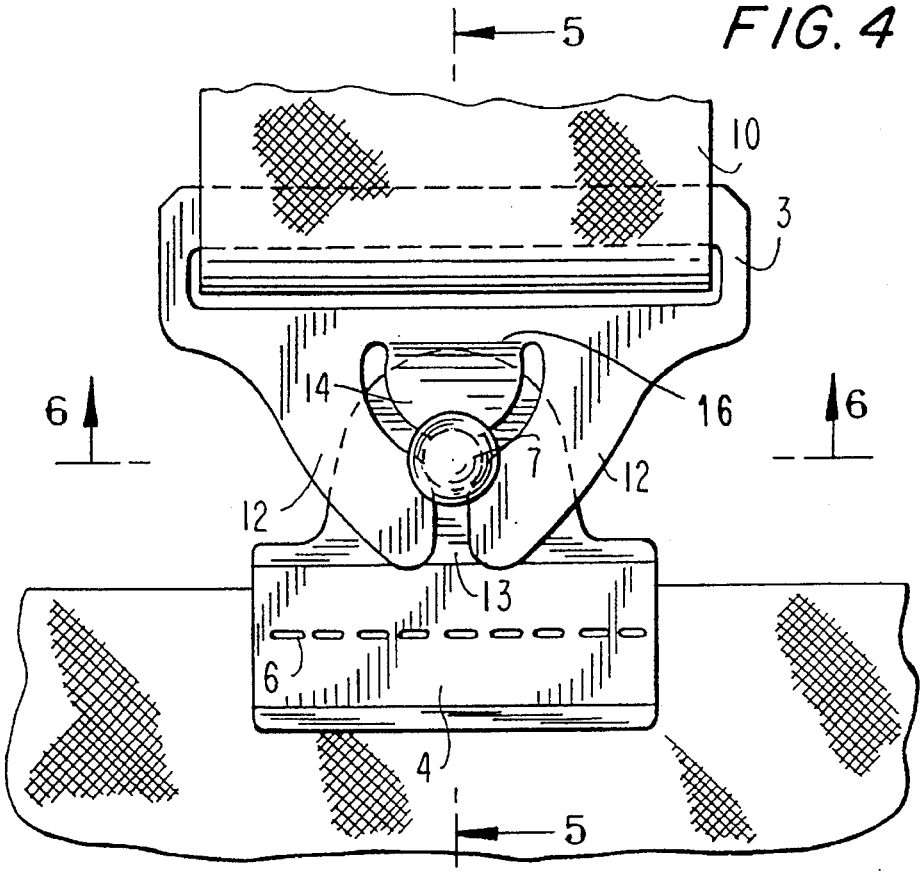
FIG. 4 is a top planar view of the breakaway buckle of the invention in the coupled state.

The proximal end of the second member 3 includes a cross bar 9 which is adapted to receive a strap 10 around it. The strap 10 is fed through the slot 11 which is defined in the second member 3 between the cross bar 9 and the body of the second member. The cross bar 9 is preferably disposed at the proximal end of the second member 3. The distal end of the second member 3 includes a pair of arms 12 which curve towards each other in the distal direction generally toward an apex. However, the arms 12 do not meet at the apex, but rather they define a gap 13 therebetween (see FIG. 4). The width of the gap 13 is slightly smaller than the width of the stem 8 of the nipple 7.

The second member 3 also includes a distally projecting tongue 14 which is situated between arms 12. The second member 3 is preferably molded from plastic such that the arms 12 and tongue 14 will be resiliently flexible for reasons discussed below. The tongue may have a line of reduced thickness 16 along its line of attachment to the second member 3 for greater flexibility. The distal end of the tongue 14 is cut to define an inwardly curved surface 15. Likewise, opposing inner surfaces of the arms 12 are cut to define inwardly curved surfaces 15. The curved surface 15 of the tongue 14 and the curved surface 15 of each arm 12 together define a discontinuous circular surface which will permit the cylindrically shaped stem 8 to fit therebetween. However, the diameter of the discontinuous circle defined by the surfaces 15 is smaller than the diameter of the top of the mushroom-shaped nipple 7.

To couple the second member to the first member, the discontinuous circle defined by the curved surfaces 15 is aligned on top of the mushroom-shaped nipple 7 belonging to the first member, and force is applied downward to snap fit the arms 12 and tongue 14 over the nipple 7. This snap fitting action is possible because of the resilient flexibility of the arms 12 and tongue 14. The curved surfaces 15 are now free to rotate around the circumference of the stem 8, thereby permitting swivelling-rotational movement of the second member with respect to the first member in the plane of the buckle. However, since the top of the nipple 7 is larger than the diameter of the discontinuous circle defined by surfaces 15, the second member 3 will be retained on the stem 8. In addition, since the diameter of the stem 8 is larger than the width of the gap 13, the stem cannot ordinarily escape through the gap to decouple the first and second buckle members.

Thus, it can be seen that the second member 3 can swivel with respect to the first member 2 by rotating around the stem 8, as illustrated in FIG. 2. The second member can swivel with respect to the first member in the plane of the buckle and neither member can pivot out of the plane of the buckle. This can facilitate a person putting on and taking off a belt-suspender combination, and allows for adjustment of the shoulder straps 10 to accommodate the user's shoulder width. This is an important advantage of the buckle of the invention.

An important safety feature of the buckle of the invention is that the second member can breakaway from the first member when the buckle is placed under a predetermined load (e.g., 20 lbs.). This is due to the presence of the gap 13. When sufficient load is placed on the buckle and the stem 8 is forced into the gap, the resiliently flexible arms 12 will be forced outward, thereby widening the gap 13 and allowing the stem 8 to escape. The resiliently flexible arms will then be free to snap back toward their rest position so that the first and second members may be coupled again for repeated use.

The buckle of the invention is advantageously used to couple a lower back supporting belt 5 to a pair of suspenders or the like. The cross bar 9 of the second member 3 will be coupled to a strap 10 of the suspenders, and the planar section 4 of the first member 2 may be sewn to the back supporting belt. Because the second member may be decoupled from the first member, a user can opt to wear the back supporting belt without the suspenders. In addition, the breakaway capability of the buckle is an important safety feature as the back supporting belt-shoulder strap combination is frequently worn near machinery which can catch the shoulder straps.

For use in other applications, the first member may also be provided with a cross bar (not illustrated) for receiving a strap.

In the preceding specification, the invention has been described with reference to specific exemplary embodiments thereof. It will, however, be evident that various modifications and changes may be made thereunto without departing from the broader spirit and scope of the invention as set forth in the appended claims. The specification and drawings are accordingly to be regarded in an illustrative rather than a restrictive sense.

What is claimed is:

1. A buckle for securing a strap to an object which will breakaway upon being subjected to a predetermined load comprising:

a first buckle member;

a second buckle member having a means for securing a strap thereto;

a means for coupling the second member to the first member which permits the second member to be swiveled with respect to the first member in the plane of the buckle, the means for coupling including a nipple belonging to one of the two buckle members and an aperture defined in the other one of the two buckle members, wherein the nipple is rotatably received within the aperture to permit swivelling of one buckle member with respect to the other buckle member in the plane of the buckle; and a means for permitting the second member to breakaway from the first member when a predetermined amount of force is applied to the buckle, the means for permitting breakaway including a resiliently flexible tongue and a pair of arms belonging to the buckle member defining the aperture, the aperture being bordered by said tongue and said arms, and the arms defining a gap therebetween.

2. The buckle according to claim 1 wherein the first member includes a planar tab.

3. The buckle according to claim 2 wherein the nipple belongs to the first member and the aperture and the arms belong to the second member.

4. The buckle according to claim 1 wherein the first member includes a means for securing a strap thereto.

5. The buckle according to claim 1 wherein the tongue is attached to the buckle member to which it belongs along a line having a thickness which is less than the thickness of the remainder of said buckle member.

6. A back supporting garment comprising:

a back supporting belt adapted to be attached around the waist of a person;

a pair of shoulder straps; and a plurality of breakaway buckles coupling the belt to the shoulder straps, each buckle including a first buckle member having a tab attached to the belt and a second buckle member defining a slot and a bar, with a shoulder strap being looped around the bar, each buckle including a means for permitting swivelling of the second buckle member with respect to the first buckle member in the plane of the buckle and a means for permitting the second member to breakaway from the first member when a predetermined amount of force is applied to the buckle, wherein the means for permitting swivelling includes a nipple belonging to one of the two buckle members and an aperture defined in the other one of the two buckle members, wherein the nipple is rotatably received within the aperture to permit swivelling of one buckle member with respect to the other buckle member in the plane of the buckle and wherein the means for permitting breakaway includes a resiliently flexible tongue and a pair of resiliently flexible arms belonging to the buckle member defining the aperture, the aperture being bordered by said tongue and said arms, and the arms defining a gap therebetween.

7. The garment according to claim 6 wherein the means for permitting swivelling includes a nipple belonging to one of the two buckle members and an aperture defined in the other one of the two buckle members, wherein the nipple is rotatably received within the aperture to permit

8. The buckle according to claim 6 wherein the tongue is attached to the buckle member to which it belongs along a line having a thickness which is less than the thickness of the remainder of said buckle member.

* * * * *

UNITED STATES PATENT AND TRADEMARK OFFICE

CERTIFICATE OF CORRECTION

PATENT NO. : 5,564,131

DATED : October 15, 1996

INVENTOR(S) : ANSCHER, J.

It is certified that error appears in the above-indentified patent and that said Letters Patent is hereby corrected as shown below:

In column 6, line 5, change "..... permit" to --.....permit swivelling of one buckle member with respect to the other buckle member in the plane of the buckle.--

Signed and Sealed this

Fifth Day of August, 1997

Bruce Lehman

*Attest:*

BRUCE LEHMAN

*Attesting Officer*

*Commissioner of Patents and Trademarks*